US006595564B1

(12) United States Patent
Hanchett et al.

(10) Patent No.: US 6,595,564 B1
(45) Date of Patent: Jul. 22, 2003

(54) ELECTRIC DOOR STRIKE HAVING DUAL LOCKING MECHANISM

(76) Inventors: Leland J. Hanchett, PO Box 1927, Cave Creek, AZ (US) 85327; Michael T. Ozee, 8675 E. Cheryl Dr., Scottsdale, AZ (US) 85258

( * ) Notice: Subject to any disclaimer, the term of this patent is extended or adjusted under 35 U.S.C. 154(b) by 0 days.

(21) Appl. No.: 10/280,438

(22) Filed: Oct. 25, 2002

(51) Int. Cl.[7] ..... E05B 15/02

(52) U.S. Cl. ..... 292/341.16; 292/341.16; 292/341.15; 292/341.17; 292/341.18

(58) Field of Search ..... 70/277, 278.7; 292/341.16, 341.15, 341.17, 341.18

(56) References Cited

U.S. PATENT DOCUMENTS 3,638,984 A * 2/1972 Davidson ..... 292/341.16
3,749,435 A * 7/1973 Balzano ..... 292/341.16
3,861,727 A * 1/1975 Froerup et al. ..... 292/341.16
4,756,566 A * 7/1988 Logas ..... 292/341.16
4,867,496 A * 9/1989 Thomas ..... 292/341.16
4,984,835 A * 1/1991 Vadacchino et al. ... 292/341.16
5,076,625 A * 12/1991 Oxley ..... 292/341.16
5,127,691 A * 7/1992 Herron et al. ..... 292/341.16
5,484,180 A * 1/1996 Helmar ..... 292/341.16
5,490,699 A * 2/1996 Uyeda ..... 292/341.16
6,082,791 A * 7/2000 Frolov et al. ..... 292/341.16
6,299,225 B1 * 10/2001 Chang ..... 292/341.16

* cited by examiner

*Primary Examiner*—Robert J. Sandy
*Assistant Examiner*—Dinesh Melwani
(74) *Attorney, Agent, or Firm*—Joseph H. Roediger; Gregory J. Nelson

(57) ABSTRACT

An electric door strike having a keeper rotatably mounted in a fixed strike case for movement between open and closed positions. The keeper includes dual solenoids with a biasing link between the solenoid plungers to urge the plungers to a non-actuated position. Changing the biasing link in the keeper changes the mode of operation. The application of an actuating signal to a solenoid moving the plungers to an actuated position which can be either the fail-safe or fail-secure mode of operation depending on the biasing link employed.

27 Claims, 4 Drawing Sheets

ELECTRIC DOOR STRIKE HAVING DUAL LOCKING MECHANISM

BACKGROUND OF THE INVENTION

This invention relates to door locking mechanisms and, in particular, to an electric door strike having a dual locking mechanism which includes internally mounted solenoids for use in the fail-safe or fail-secure modes of operation.

An electric door strike typically includes a strike case fixedly mounted in a door jamb. The strike case contains a pivotally mounted keeper for retaining the deadbolt and door latch in the strike case under the control of the door-mounted lock mechanism. In addition to the control provided by the local lock mechanism, the keeper can be used to permit opening or securing of the door in accordance with an electrical actuating signal applied from a remote location.

In the fail-secure mode of operation, the premises are secured in the event of a power failure by a locking mechanism that causes the keeper to remain engaged in the strike case in the case of power failure. For the fail-safe operating mode, a power failure results in a release of the keeper thereby allowing a door to be opened without regard to the state (locked or unlocked) of the individual lock thereon.

An electrically operated door strike which can provide fail-secure mode of operation is disclosed in U.S. Pat. No. 3,640,560 to Zawadzki et al. In this door strike, the release of the strike keeper is externally controlled by means of a small solenoid located within the strike case. The solenoid interacts with a locking cam to release the keeper upon receipt of the signal. The locking mechanism is contained within the keeper assembly and does not engage the strike case. As a result, there is no direct contact between the doorjamb and the rotatable keeper and the mechanism is not sufficiently durable determined strong forces by one seeking unauthorized entry.

The provision of both fail-safe and fail-secure modes of operation in a single locking mechanism is accomplished in the electric strike mechanism disclosed in U.S. Pat. No. 5,484,180 to Helmar. The single solenoid mechanism shown therein utilizes a locking yoke which mechanically controls the rotation of the keeper. The mechanical linkage and single solenoid is contained within the housing. The enhanced versatility of the Helmar '180 mechanism is provided by the use of a reversible plunger enabling the device to function in both modes.

Accordingly, the present invention is directed to an electric door strike having dual solenoids to provide engagement between the plungers and the strike case affixed to the door jamb in the fail secure mode of operation. The use of dual solenoids secures the opposing sides of the keeper to reduce the likelihood of a forced entry. In addition, the subject door strike is readily converted to the fail-safe mode of operation without removal of the strike case from its mounting in the doorjamb. Further, the invention employs plungers having a novel latch head that inhibits tampering when the plungers are extended and the keeper is secured.

SUMMARY OF THE INVENTION

The present invention is directed to an electric door strike which includes a strike case for affixation to a doorjamb. The strike case is adapted to receive a bolt from a door lock and a keeper is mounted therein. The keeper is rotatably mounted in the strike case for movement between an open position which allows a lock bolt to exit the strike case and a closed position which secures the lock bolt in the strike case and prevents opening of the door.

The keeper is provided with first and second solenoids, each solenoid having an electrical connection for the application of actuating signals thereto. Each solenoid has a plunger with a latch head thereon for engagement with a receiving socket in the strike case. Access is provided to one of the plungers to allow substitution of a plunger having a different latch head thereon for use in the fail-safe operating mode wherein the door can be opened in the absence of an actuating signal.

In the fail-secure mode, the application of an actuating signal causes the plungers to retract thereby removing the latch heads from the corresponding receiving sockets in the strike case. The dual plungers are extended in the absence of the actuating signals by the action of a biasing link between the plungers which urges the plungers outwardly for engagement with the receiving sockets thereby establishing the fail-secure mode of operation.

The replacement of a plunger used for fail-secure operation with a plunger having a different latch head coupled with a modification of the biasing link provides the fail-safe operating mode for the door strike. The remaining plunger with initial latch head is urged by the biasing link out of engagement with the receiving socket in the absence of an actuating signal. Thus, the present door strike can be utilized as a fail-safe or fail-secure locking mechanism with only minor modification.

The fail-secure mode of operation results in two latch heads being received in corresponding sockets in the top and bottom of the strike case. Thus, the security of locking in the absence of power is greatly enhanced. In the fail-safe mode, a single latch head is used to engage the strike case. This latch head is withdrawn upon a power failure to permit the keeper to be rotated to the open position by applying pressure to the door regardless of the state of the door mounted lock.

To inhibit a dislodging of the latch head from the adjacent receiving socket by the application of an external force, the outer end of the latch head is provided with a non-orthogonal end surface having an undercut. A mating undercut is provided in the receiving socket. As a result, forces tending to move the latch head laterally result in the undercut portion of the latch head engaging the receiving socket. The novel configuration of the latch head and receiving socket limit lateral movement of the keeper when the plunger is extended to enhance the security of the locking mechanism.

Further features and advantages of the invention will become more readily apparent from the following detailed description of the preferred embodiment when taken in conjunction with the accompanying drawings.

DESCRIPTION OF THE PREFERRED EMBODIMENT

Figure 1:
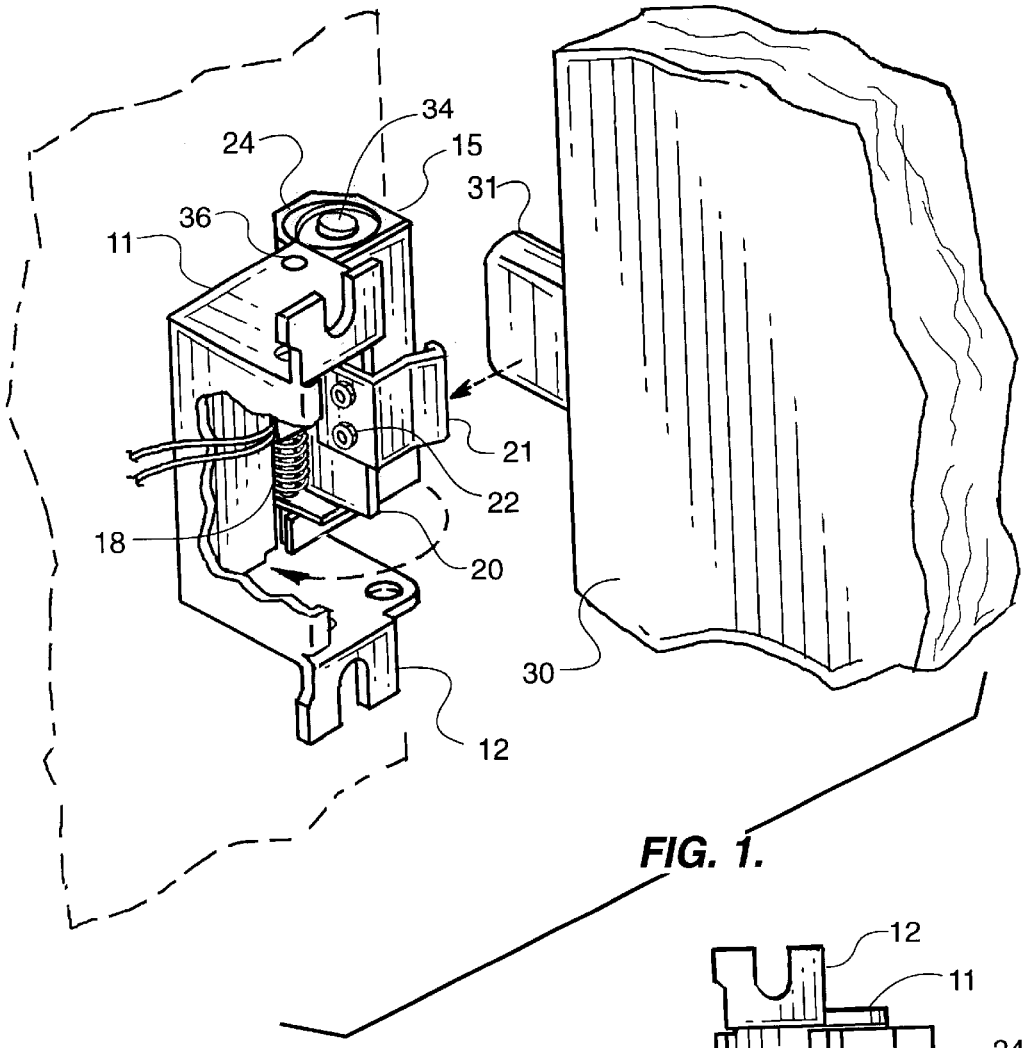
FIG. 1 is a view in perspective showing a preferred embodiment of the invention.

Referring now to the embodiment of FIG. 1, an electric door strike is shown comprising a strike case 11 dimensioned for mounting in a receptacle in a door jamb (not shown) and secured by threaded fasteners positioned in the slots in flanges 12.

A keeper 15 is mounted in the strike case for rotation about an axis defined by axial rods 36, 37 which extend between from the top and bottom end members of strike case 11. A pair of springs 17, 18 are located about the spaced axial rods 36, 37 to provide a biasing force which urges the keeper to a normally open position and places the return member 20 in the position shown in FIG. 1 where the member 20 is positioned at a right angle to the inside surface of the keeper 15. As noted from FIG. 5, the return member 20 is mounted for rotation on the axial rods 36 and 37.

An extension 21 is affixed to the return member 20 by fasteners 22 and is shown extending forwardly and outwardly of the member 20. The extension arm is positioned to contact a dead bolt 31 extending from the edge of door 29 as it moves in the direction of the arrow in FIG. 1. The extension arm enables the closure of the door 29 with the dead bolt extended to rotate the keeper 15 to the return or closed position. During normal operation of the electrically actuated locking mechanism, the release of the keeper enables the door to be opened and the keeper rotates to the position as shown FIG. 1. The action of the spring 18 of FIG. 6 urges the keeper to the open position. The combination of extension arm 21 and return member 20 cause the keeper to close by contact with the deadbolt. If the door lock includes only a beveled latch bolt, the extension arm 21 is removed and the return member 20 is secured to the strike case. The biasing force of spring 17 of FIG. 5 urges the keeper to a closed position when the keeper 11 has been opened by the latch bolt alone. The keeper 15 is provided with a plurality of chamfered surfaces 24 on the external surface so that the beveled surface of a latch bolt readily travels thereacross in the return to the strike case.

Figure 2:
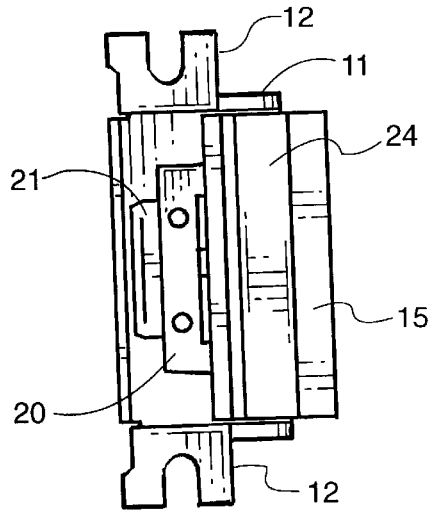
FIG. 2 is a side view of the embodiment of FIG. 1, showing the keeper in a closed position.

The keeper 15 is shown in the closed position in FIG. 2 with the return member 20 and extension arm 21 located in the interior of the strike case 11. The strike case is shown in the top view of FIG. 3 in the closed position with a receiving socket 30 located on the top surface. A like socket is located on the bottom surface of the strike case 11. The axial rods 36 and 37 extend into mating openings in the adjacent surfaces of the strike case and define the axis of rotation of the keeper.

Figure 3:
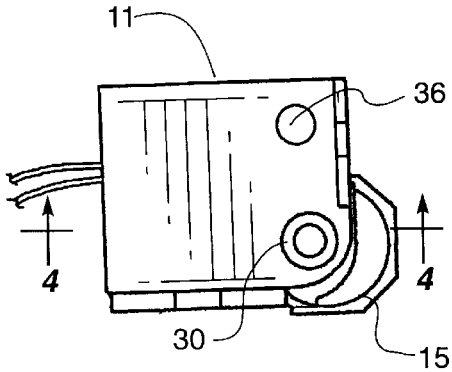
FIG. 3 is a top view of the embodiment shown in FIG. 2.
Figure 5:
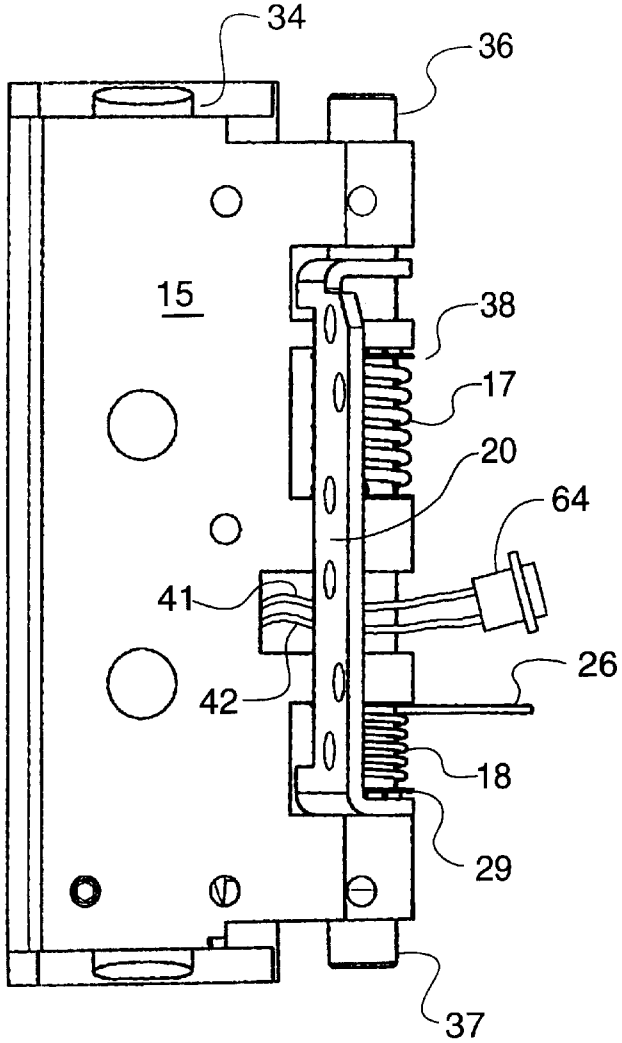
FIG. 5 is a side view of the keeper of the embodiment shown in FIGS. 2 and FIG. 3.
Figure 4:
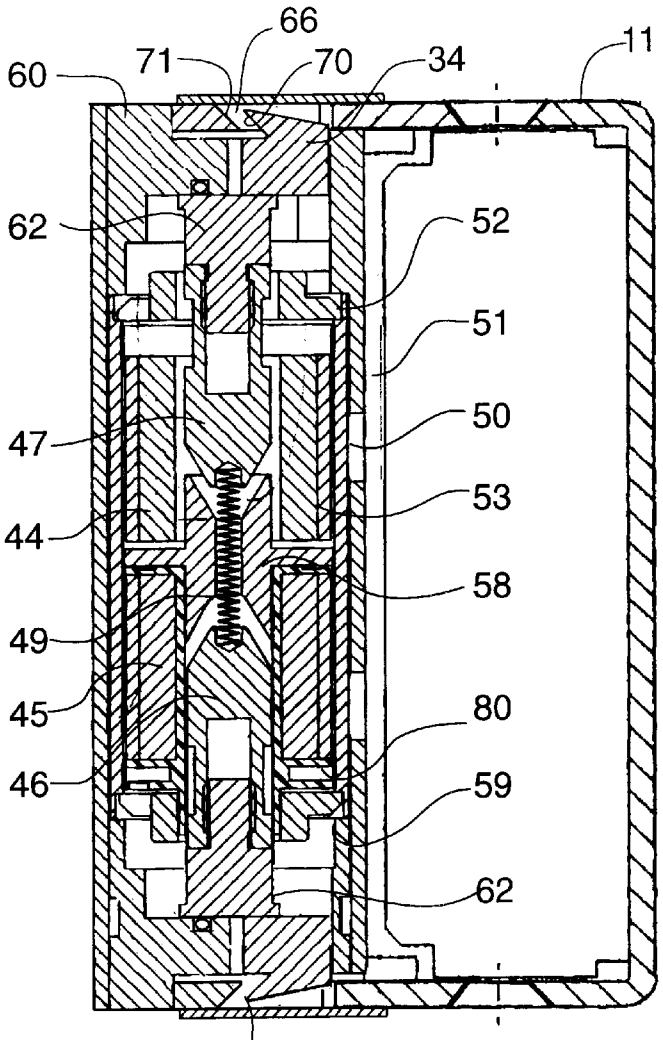
FIG. 4 is cross-sectional view taken along line 4—4 of FIG. 3 of the embodiment adapted for fail-secure operation.

The keeper assembly is shown in the cross-sectional view of FIG. 4 taken along the corresponding lines of FIG. 3 and the side view of FIG. 5 showing the keeper removed from the strike case. In FIG. 5, the placement of springs 17 and 18 on the axial rods 36 and 37 is shown. Spring 18 extends outwardly at free end 26 to contact the strike case and urge the keeper to an open position. In the fail secure mode, the keeper is closed by the bolt of the door mounted mechanism contacting the extension arm mounted on return member 20 and is maintained in that position by the protruding end 34 of the latch heads which enter the receiving sockets 30 of the strike case. The spring 17 is located on axial rod 36 and provides a restoring force for maintaining the keeper and return member 20 at a right angle position.

The axial rods 36, 37 are provided with collars 38, 39 respectively which secure the rods in the keeper 15 and limit axial movement to that needed to assemble the keeper in the strike case and to facilitate replacement of a plunger. The keeper is provided with a central slot 41 between the ends of rods 36, 37 to serve as a passageway for wire pairs 42 which extend inwardly to the solenoids 44, 45 seen in FIG. 4. The keeper 15 is shown positioned within the strike case 11 in the secure position in FIG. 4.

The solenoids 44, 45 each contain a plunger 46, 47 in axial alignment with a biasing link 49 located therebetween. In both fail-secure and fail-safe modes of operation, the link provides a force urging a plunger outwardly of the respective solenoid. As shown, solenoid tube 50 having a coil spacer 51 and flux washer 52 at the opposing ends houses the windings 53 of the solenoid. A solenoid spacer 58 is interposed between the adjacently spaced solenoids. The spacer is provided with tapered sockets which receive the tapered ends of the plungers and limit lateral movement thereof. The solenoids are maintained in the aligned position in the keeper by a shoulder 59 formed on the interior surface of the keeper and a removable insert 60 at the opposing end of the keeper. The insert 60 extends inwardly to contact the flux washer 52.

As shown in FIG. 4, plungers 46, 47 are each provided with a hollow core for receiving a latch head 62 press fit therein. The latch heads are urged to a secure position as shown by the biasing link 49 which extends therebetween through the spacer 58. When the solenoids are actuated by the application of signals to external connector 64, the plungers retract the latch heads from within the receiving sockets 30 of the strike case and the keeper is then free to rotate about axial rods 36, 37 to the open position.

The protruding end of the latch head 15 provided with an inclined end surface 70 having an undercut located beneath one edge. The incline provides an end surface that is nonorthogonal to the axis of the plunger. As a result, the latch head is urged inwardly by the strike case upon closure. Also, the latch head is provided with an undercut that faces an undercut 71 in the receiving socket. The application of an external force to the keeper in the direction to open the keeper, when the keeper is secured drives the mating surfaces of the undercuts into contact reducing the ability of an intruder to defeat the security of the keeper by the use of an implement or by the direct application of force.

Figure 6:
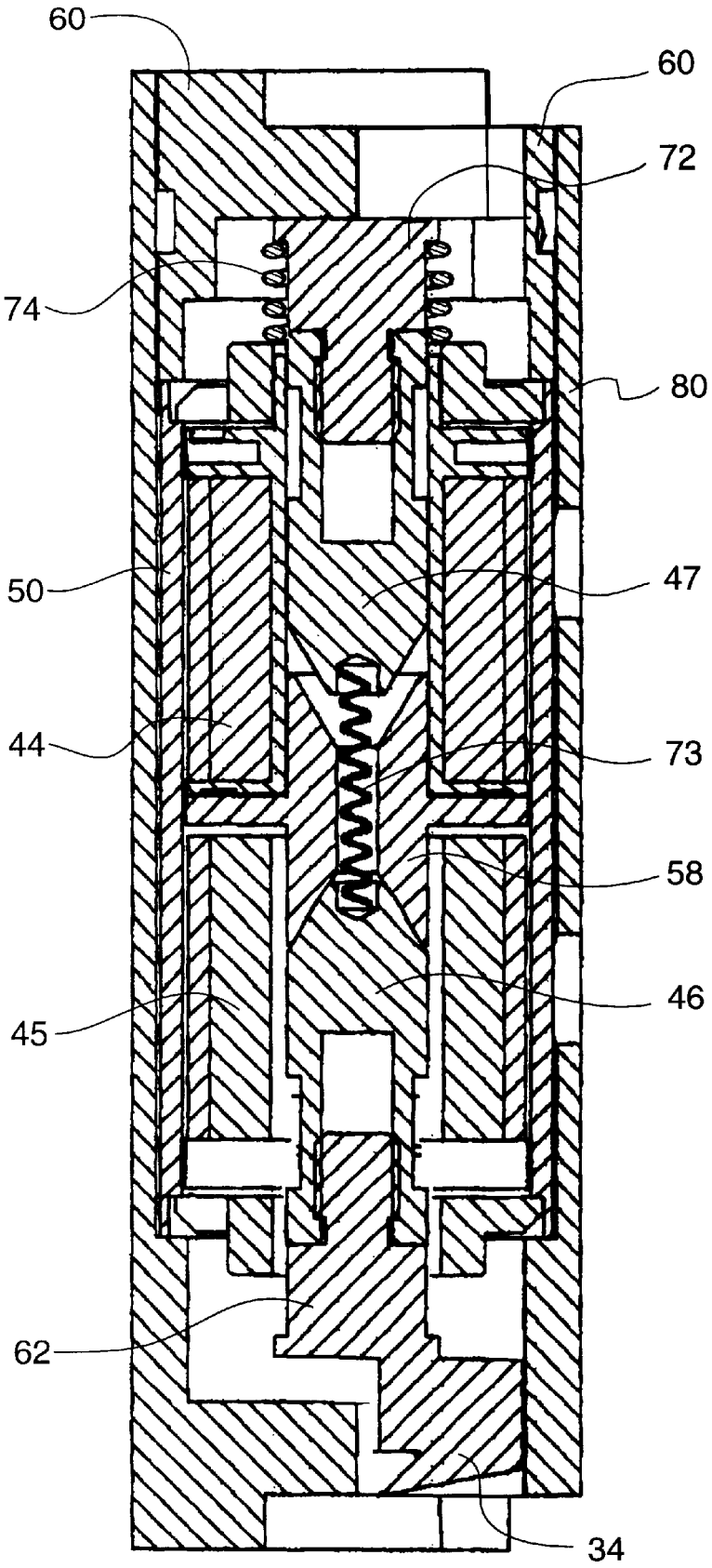
FIG. 6 is a cross-sectional view taken along line 4—4 of FIG. 3 of the embodiment adapted for fail-safe operation.

As shown in the fail-secure mode of FIG. 4, the keeper is provided with identical latch heads 62 press fit into the corresponding plungers 46, 47. The plungers are coupled together by a biasing link 49 comprised of a spring extending between recesses in the adjacent inner ends of the plungers. The spring urges the latch heads to the position shown. The mode of operation of the electric door strike is changed to the fail-safe mode of operation by the replacement of a latch head and biasing link as seen in FIG. 6. Replacement is effected by decoupling the keeper 15 from the strike case by means of compressing one or both of the axial rods.

Upon removal of the keeper, the insert 60 is withdrawn from the keeper thereby allowing the plunger 47 to be withdrawn from solenoid 44. The latch head 62 is removed from the end of the plunger and replaced with a latch head 72 having a blunt end without the offset engaging end of latch head 62. Alternatively, replacement of the plunger and latchhead as a single unit can be made. Also, the biasing link which had comprised spring 49 in the fail-secure mode is removed and replaced by linking rod 73. Rod 73 is threaded at each end so that it is first threaded into plunger 47 before placement into solenoid 44. A biasing spring 74 placed over the solenoid and moved into position against the blunt end of latch head 72 supplies the biasing force for both latch heads in the fail-safe mode shown in FIG. 6. After placement of the plunger into the solenoid with the rod 73 threaded into plunger 47 and the spring 74 in position about latch head 72, the latch head is rotated so that rod 73 threads into plunger 46. As a result, the plungers are linked to move in the same direction. In the absence of an actuating signal applied to solenoid 44, the spring 74 maintains latch head 62 in the withdrawn position as shown in FIG. 6 with the inner end of plunger 46 adjacent to the spacer 58. The modifications made to the biasing link and the substitution of a blunt latch head to provide fail safe operation are accompanied by the application of an actuating signal to conductor pair 41. Control of the actuating signals can be provided by a microprocessor located at a central station which typically serves a number of portals located throughout a large building.

Figure 7:
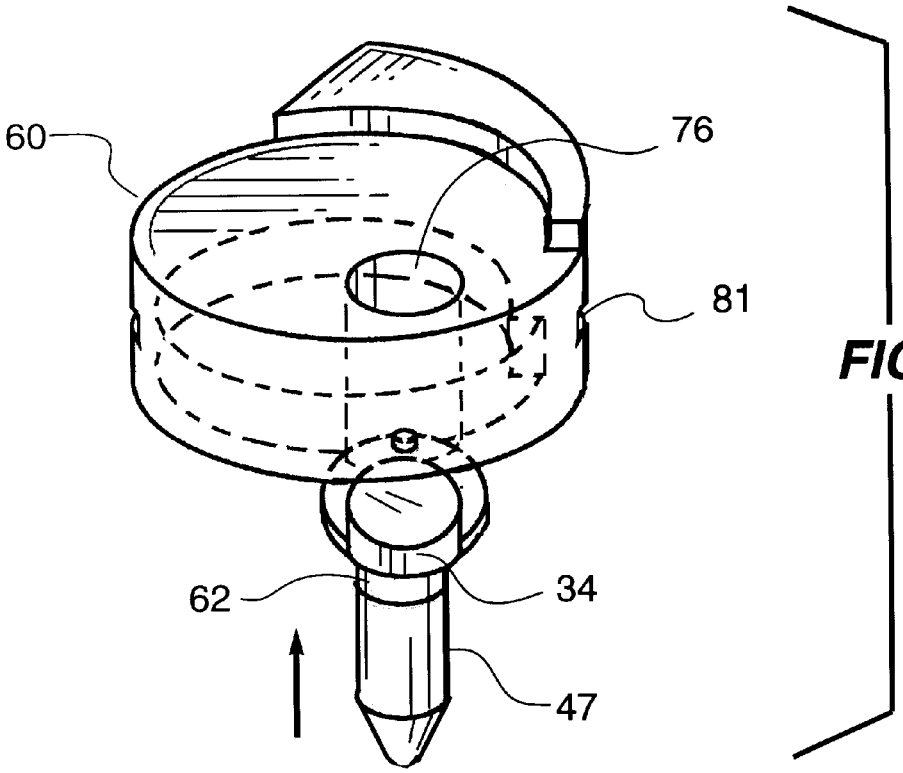
FIG. 7 is an exploded view in perspective of a latch head and insert in the embodiment of FIG. 1.

As discussed herein, the preferred embodiment utilizes a keeper having a removable end insert 60 shown in FIGS. 1 and 6. This embodiment enables the electric door strike to be readily converted between fail-secure and fail-safe modes of operation. The insert 60 is shown in FIG. 7 with an offset opening 76 that receives end 34 of latch head 62. As mentioned, latch head 62 is fitted into plunger 47. The end 34 is offset mounted on the latch head 62 to correspond with the offset of opening 76 in the insert 60. The offset enables the plunger 47 to be axially aligned with the solenoid 44 and causes the undercut in end 70 to align with the undercut 71 in the receiving socket. The insert is held in position by set screws (not shown) located in the wall 80 of the keeper and entering the positioning slots 81 in the insert.

The latch head 62 is provided with travel limit pin 77 which limits the latch head from extending too far beyond insert 60. A similar pin is utilized on the latch head at the opposing end of the keeper. Since the blunt end of latch head 72 lacks an engaging end, no registration pin is located thereon.

Figure 8:
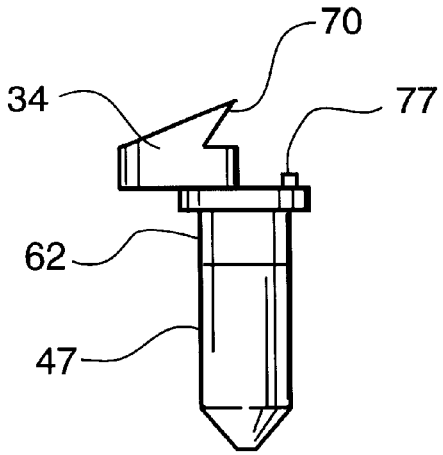
FIGS. 8 and 9 are side views of the latch heads shown in FIG. 6.
Figure 9:
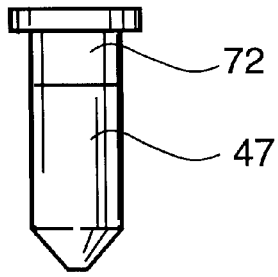

When converting the keeper to fail safe operation, the latch head 72 of FIG. 9 has a blunt end substituted for the latch head of FIG. 8. When the plunger encircled by spring 74 is inserted into the solenoid and secured by linking rod 73 to the adjacent plunger 46 as shown in FIG. 6, the insert 60 is placed in the strike case and secured. The non-actuated position of FIG. 6 is changed upon the application of an actuating signal to solenoid 44.

In operation, the application of the appropriate actuating signal to the subject door strike causes one or both of the solenoids to be energized and causes the corresponding plunger or plungers to overcome the force of the biasing link and either free or secure the keeper to the strike case. The double latch head security of the invention in the fail-secure mode makes the electric door strike extremely difficult to defeat. Furthermore, the undercut of the engaging head resists tampering by the application of force to the interface between the keeper and strike case by urging the undercut into contact with a corresponding undercut in the strike case. The transition between fail-secure and fail-safe modes of operation is accomplished by removal of the keeper with access to the interior thereof provided by the removable insert located at one end of the keeper. Thus, the present invention provides a durable and versatile electric door strike that is extremely difficult to defeat.

While the foregoing description has been with reference to a preferred embodiment of the invention, it is to be noted that variations and modifications may be made therein without departing from the scope of the invention.

What is claimed is:

1. An electric door strike which comprises:

a. a strike case adapted to receive a bolt, said strike case having first and second opposing ends, at least one end having a receiving socket therein;

b. a keeper rotatably mounted in said strike case for movement between open and closed positions;

c. first and second solenoids positioned in said keeper, said solenoids including first and second plungers respectively, each plunger having an inner end and an outer end; said plungers being adapted for movement between an actuated position and a non-actuated position;

d. a first latch head affixed to the outer end of the plunger of the first solenoid, said latch head being dimensioned to enter a receiving socket in the strike case; and e. a biasing link engaging the first and second plungers and urging said plungers to a non-actuated position the application of an actuating signal to at least one of said solenoids moving the first and second plungers to an actuated position whereby said first latch head moves into relation to the receiving socket.

2. The electric door strike of claim 1 wherein said plungers are in alignment along an axis in said keeper.

3. The electric door strike of claim 2 wherein said keeper contains a removable end insert having an opening for permitting movement of the first latch head therein.

4. The electric door strike of claim 3 wherein said biasing link comprises a biasing spring engaging the second plunger, and a linking coupler attached to said first and second plungers.

5. The electric door strike of claim 4 wherein said biasing spring urges the first plunger into the first solenoid, the application of an actuating signal to the second solenoid causing the first latch head to enter a receiving socket.

6. The electric door strike of claim 5 wherein said linking coupler is a rod removably attached to the inner ends of the first and second plungers.

7. The electric door strike of claim 6 further comprising a spacer mounted in said keeper between the first and second solenoids, said spacer having a channel therethrough for receiving said rod.

8. The electric door strike of claim 7 wherein said first and second plungers have tapered inner ends adjacent the spacer, said spacer having a mating taper therein for limiting movement of said plungers.

9. The electric door strike of claim 8 wherein said plungers move along the axis and the outer end of said first latch head is non-orthogonal to the axis.

10. The electric door strike of claim 9 wherein the outer end of said first latch head is offset from said axis.

11. The electric door strike of claim 10 wherein said latch head includes a limit pin for limiting axial movement of the latch head.

12. The electric door strike of claim 11 wherein the outer end of said first latch head includes an inclined surface having an undercut thereacross, and the receiving socket of the strike case has a corresponding undercut thereacross for limiting lateral movement of said outer end.

13. The electric door strike of claim 3 wherein said biasing link comprises a linking spring interposed between the first and second plungers whereby said plungers are capable of movement in opposing directions along an axis.

14. The electric door strike of claim 13 further comprising a second latch head affixed to the plunger of the second solenoid, the application of actuating signals to the first and second solenoids causing the first and second latch heads to retract from the receiving sockets in the strike case.

15. The electric door strike of claim 14 further comprising a spacer mounted in said keeper between the first and second solenoids, said spacer having a channel therethrough for receiving said linking spring.

16. The electric door strike of claim 15 wherein said first and second plungers have tapered inner ends adjacent the spacer, said spacer having mating tapers therein for receiving said inner ends and limiting movement thereof.

17. The electric door strike of claim 16 wherein the outer end of at least one of said latch heads is removably attached to the corresponding plunger.

18. The electric door strike of claim 17 wherein the outer end of at least one latch head includes a non-uniform surface having an undercut thereacross, and the receiving socket has a corresponding undercut thereacross for limiting lateral movement of said outer end.

19. The electric door strike of claim 18 wherein the outer end of said at least one latch head is offset from said axis.

20. The electric door strike of claim 19 wherein said at least one latch head includes a limit pin for limiting axial movement of the latch head.

21. The keeper in accordance with claim 20 wherein said first and second solenoids are located in alignment in said housing for movement along an axis.

22. In combination with a strike case for receiving a door bolt therein, a movable keeper for engaging the strike case to retain and release the bolt in accordance with a protocol, said keeper comprising:

a) a housing rotatably mounted in the strike case;

b) first and second solenoids located in said housing;

c) first and second plungers movably contained in the respective solenoids, each plunger having an inner end and an outer end;

d) electrical connectors coupled to the first and second solenoids for the application of actuating signals thereto, said actuating signals moving said plungers between actuating and non-actuating positions;

e) a biasing link contacting the inner ends of the first and second plungers for urging said plungers to the non-actuating position in accordance with the protocol, and f) a first latch head affixed to the outer end of the first plunger, said latch head being dimensioned to engage the strike case and inhibit rotation of said housing whereby the door bolt is retained by the housing.

23. The keeper in accordance with claim 22 further comprising a spacer mounted between the first and second solenoids, said spacer having a channel therethrough for receiving the biasing link.

24. The keeper in accordance with claim 21 further comprising a second latch head affixed to the outer end of the second plunger.

25. The keeper in accordance with claim 23 wherein said second latch head is removably affixed to the second plunger.

26. The keeper in accordance with claim 24 wherein said biasing link includes a spring, positioned between the inner ends of said plunger.

27. The keeper in accordance with claim 25 wherein said biasing coupler includes a biasing spring engaging the second plunger and a linking rod attached to the first and second plungers.

* * * * *